US006364816B1

(12) United States Patent
Tang et al.

(10) Patent No.: US 6,364,816 B1
(45) Date of Patent: Apr. 2, 2002

(54) ARM-BUILDING DEVICE

(76) Inventors: Jack Tang, 1F, No. 7, Alley 27, Lane 247, Chang Cheng Rd., Hsin Tien City, Taipei Hsien; Hui-Nan Yu, No. 14, Lane 252, Chien Kuo Rd., Tao Yuan City, both of (TW)

( * ) Notice: Subject to any disclaimer, the term of this patent is extended or adjusted under 35 U.S.C. 154(b) by 0 days.

(21) Appl. No.: 09/669,629

(22) Filed: Sep. 26, 2000

(51) Int. Cl.[7] ..... A63B 23/16
(52) U.S. Cl. ..... 482/126; 482/49; 482/121
(58) Field of Search ..... 482/44–46, 49, 482/121, 122, 126, 907, 908

(56) References Cited

U.S. PATENT DOCUMENTS 4,465,276 A * 8/1984 Cox ..... 482/128
5,246,413 A * 9/1993 Koblick ..... 482/126
5,409,436 A * 4/1995 Chang ..... 482/49
5,674,164 A * 10/1997 Kravitz ..... 482/126

* cited by examiner

*Primary Examiner*—Glenn E. Richman
(74) *Attorney, Agent, or Firm*—Browdy and Neimark P.L.L.C.

(57) ABSTRACT

An arm-building device comprises a frame having a coupling portion. Two engagement members are rotatably mounted on the frame such that they are meshed with each other. The engagement members are provided with a connection portion and a pivoting portion. Two operation rods are connected with the connection portions of the engagement members. Two traction members are pivotally fastened with the pivoting portions of the engagement members such that the traction members are pivoted at one end thereof by a bolt. A resilient member is connected at one end with the coupling portion of the frame and is fixed at other end by the bolt. The two operation rods are actuated by hands of an exerciser, so as to actuate the engagement members to rotate to cause the two traction members to displace upward to stretch the resilient member. A recovery spring force is thus brought about by the stretched resilient member to work against both arms of the exerciser.

9 Claims, 6 Drawing Sheets

ARM-BUILDING DEVICE

FIELD OF THE INVENTION

The present invention relates generally to an exercise device, and more particularly to an arm-building device.

BACKGROUND OF THE INVENTION

As shown in FIG. 1, an arm-building device 80 of the prior art comprises two movable rods 81 and a resilient element 89. The two movable rod 81 have a fastening portion 82 which is provided in one side with an edge 83. The other side of the fastening portion 82 is level with the fastening portion 82 and is provided with an arm rod 84 extending downward therefrom to form a grip which is provided with a soft grip cover 85. The fastening portion 82 serves as a pivot of the two movable arms 81. Each edge 83 is provided with an upper hooked portion 831 and a lower hooked portion 832. Located between the edge 83 and the upper hooked portion 831 and the lower hooked portion 832 are an upper recess 833 and a lower recess 834, in which the resilient element 89 is disposed. In use, the user holds the soft grip cover 85 to operate the movable rods 81 in accordance with various positions of the resilient element 89. As the resilient element 89 is at work, the resistance is brought about to attain the exercise effect.

Such a prior art device as described above is defective in design in that it does not provide its user a support to enable the user to apply the force uniformly, so as to prevent the movable rods from swinging aside to inflict an injury on the user or bystander.

SUMMARY OF THE INVENTION

The primary objective of the present invention is to provide a safe arm-building device.

The arm-building device of the present invention comprises a frame, two engagement members, two operation rods, two traction members, and a resilient member. The frame is provided in the bottom with a coupling portion. The two engagement members are rotatably mounted on the frame and are meshed with each other. The engagement members are provided with a connection portion and a pivoting portion which is separated from the axis of the engagement members by a predetermined distance. The operation rods are connected at one end with the connection portion of the engagement members such that other end of the operation rods serves as a hand grip to facilitate the operating of the operation rods, thereby actuating the two engagement members to turn. The traction members are pivoted at one end with the pivoting portion of the engagement members by a predetermined distance. The operation rods are connected at one end with the connection portion of the engagement members such that other end of the operation rods serves as a hand grip to facilitate the operating of the operation rods, thereby actuating the two engagement members to turn. The traction members are pivoted at one end with the pivoting portion of the engagement members such that the traction members are pivoted with each other by a bolt body. The resilient member is fixed at one end with the coupling portion of the frame, and at other end with the bolt body. As the engagement members are actuated by the operation rods to turn, the two traction members are actuated to displace upwards. The resilient member is pulled to bring about the resistance force to attain the exercise effect.

DETAILED DESCRIPTION OF THE INVENTION

Figure 1:
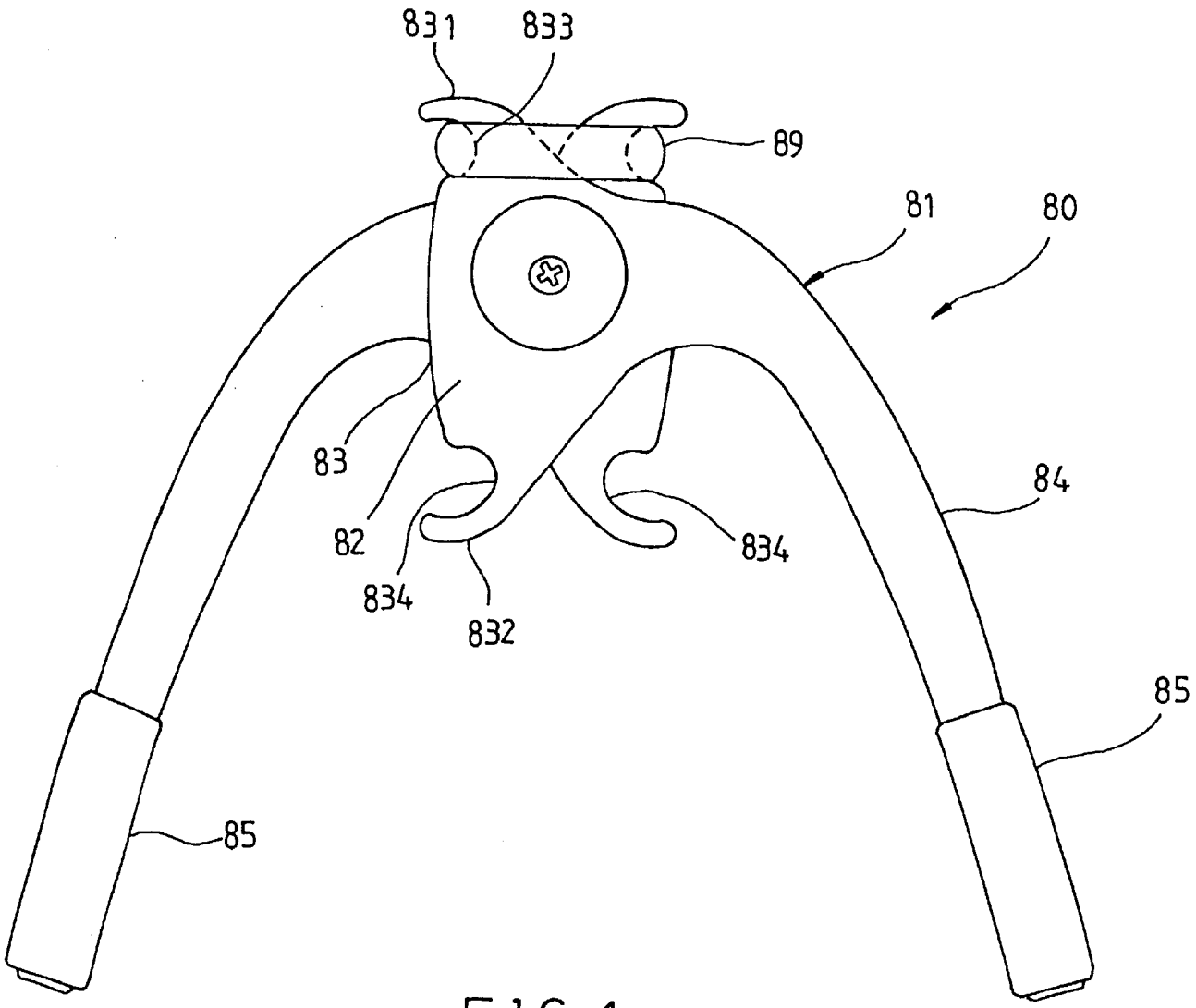
FIG. 1 PRIOR ART
FIG. 1 shows a perspective view of an arm-building device of the prior art.
Figure 2:
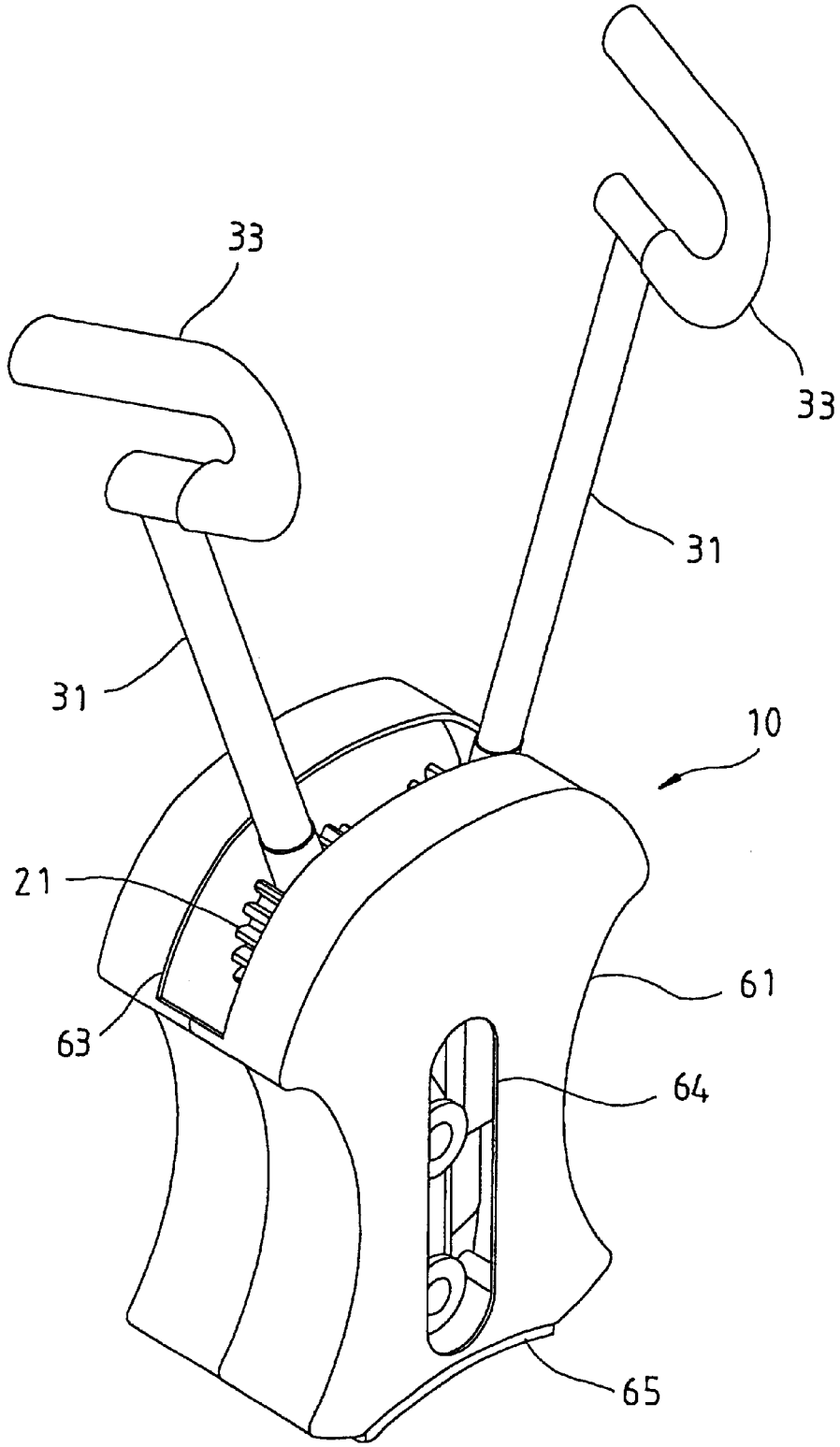
FIG. 2 shows a perspective view of a preferred embodiment of the present invention.
Figure 3:
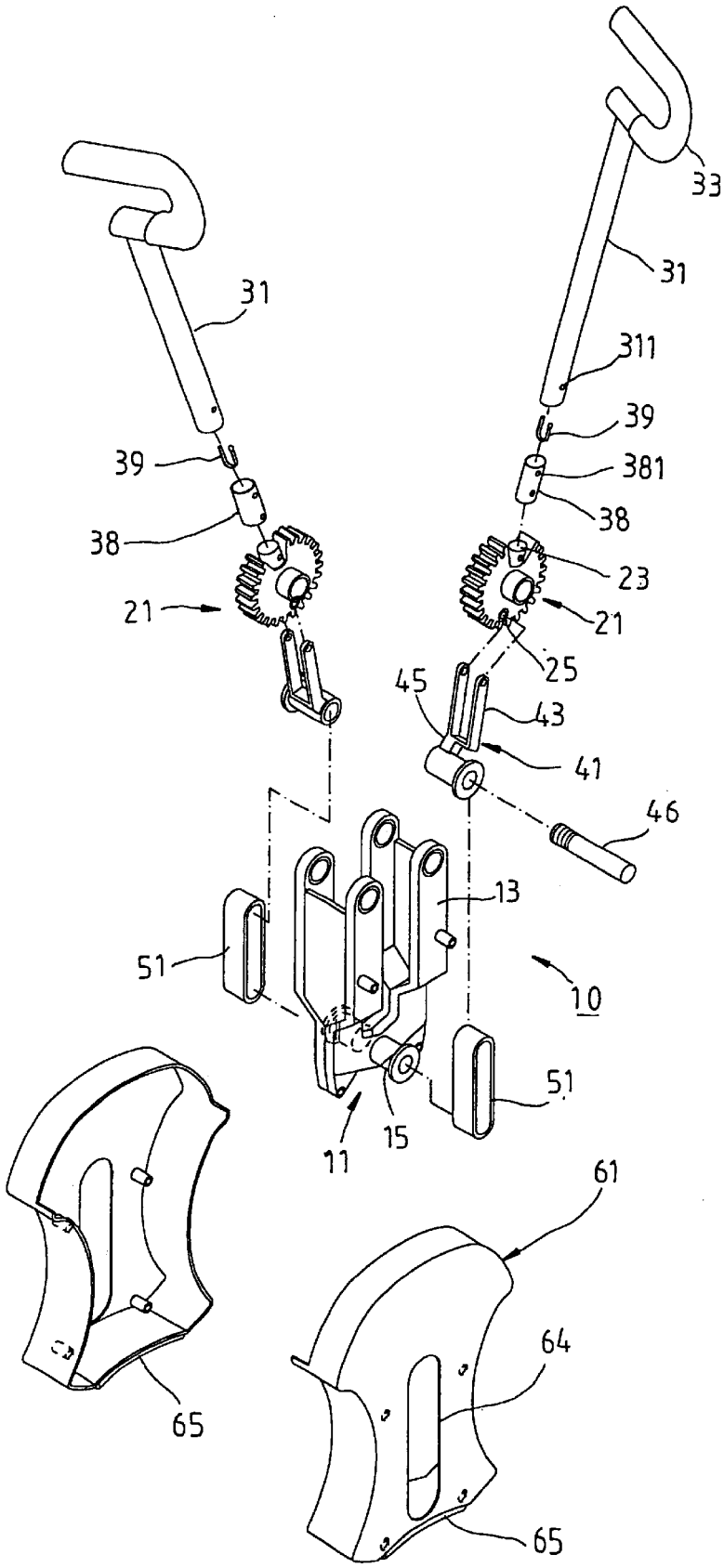
FIG. 3 shows an exploded view of the preferred embodiment of the present invention.

As shown in FIGS. 2 and 3, an arm-building device 10 of the preferred embodiment of the present invention comprises a frame 11, two engagement members 21, two operation rods 31, two traction members 41, and two resilient members 51.

The frame 11 has two support arms 13 extending upward from the bottom of the frame 11 to form a V-shaped construction. The frame 11 is provided at both ends of the bottom thereof with a coupling portion 15.

The two engagement members 21 are toothed disks, which are rotatably mounted on the top ends of the two support arms 13 and are engaged with each other. The engagement members 21 are provided with a connection portion 23, which is a tubular body extending outward from the disk, and a pivoting portion 25 which is a pivoting hole and is separated from the axis of the engagement member 21 by a predetermined distance.

The two operation rods 31 are connected at one end with the connection portion 23 by an intermediate tube 38, which is provided with a through hole 381 and an elastic retainer 39 having one end jutting out of the through hole 381. The operation rod 31 is fastened at one end with the intermediate tube 38. The elastic retainer 39 is put through the insertion hole 311 of the operation rod 31 to fix the operation rod 31, which can be separated from the operation rod by pressing the elastic retainer 39 inward. The operation rods 31 are provided at other end with a grip 33. In operation, the two engagement members 21 are actuated to turn by the two operation rods 31.

The two traction members 41 are provided at one end with two connection arms 43 extending outwards and parallel to each other, and at other end with a coupling arm 45. The traction members 41 and the engagement members 21 are connected such that the two connection arms 43 are located at two ends of the engagement member 21. A pin 44 is used to pivot the two connection arms 43 and the pivoting portion 25. The coupling arms 45 of the two traction members 41 are stacked together pivotally by a bolt body 46.

The resilient members 51 are rubber rings, which are engaged at one end with the coupling portion 15 of the frame 11, and at other end with the bolt body 46. The resilient members 51 are disposed at both ends of the frame 11 for providing a recovery spring force.

The present invention further comprises a housing 61, which is provided at the top with an operation hole 63 via which the operation rods 31 are jutted out. The housing 61 is provided with a long hole 64 corresponding in location to the resilient member 51 to facilitate the replacing of the resilient member 51. The housing 61 is provided at the bottom with a pad 65 which is rested against the belly of a user of the device.

Figure 4:
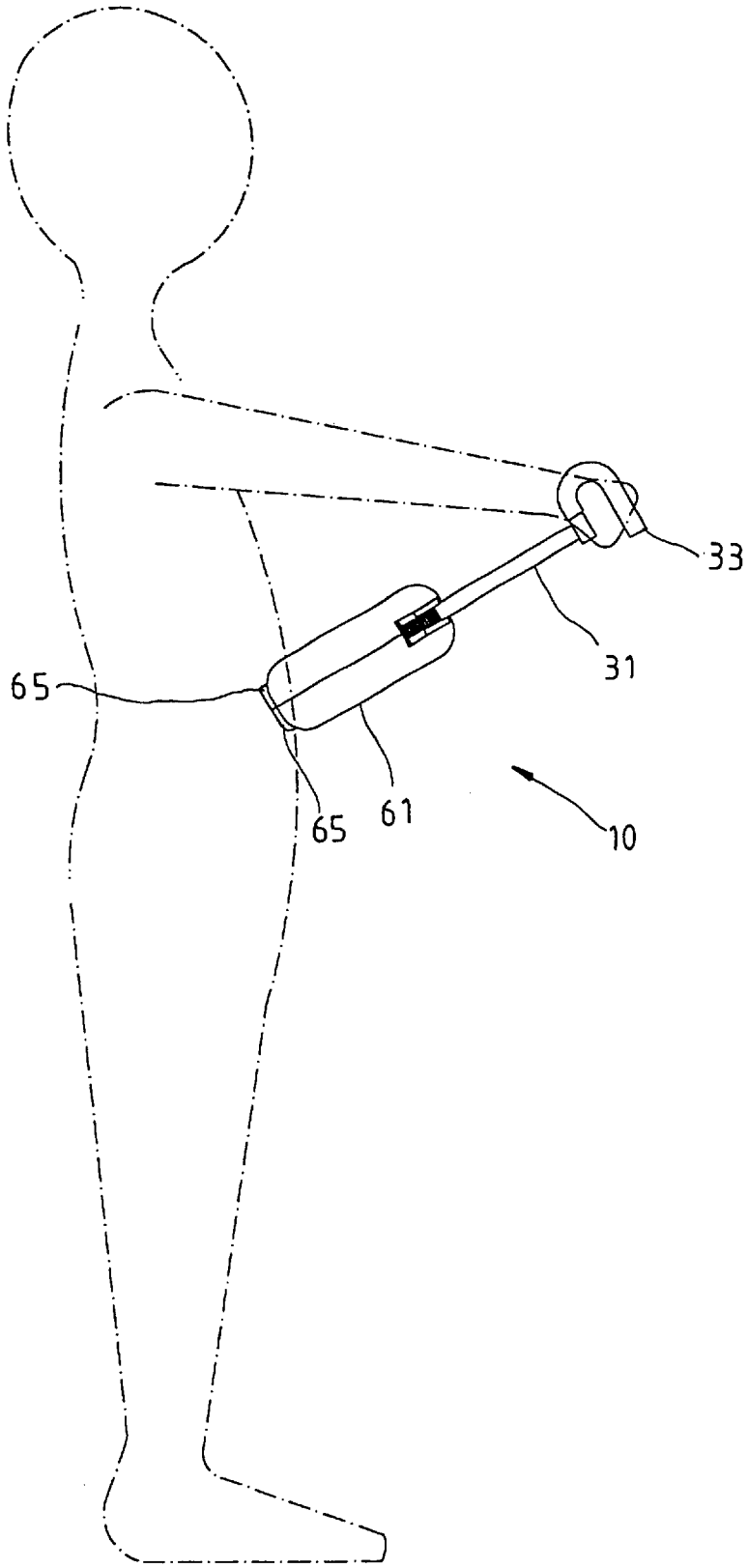
FIG. 4 shows a schematic view of the preferred embodiment of the preferred embodiment of the present invention in use.
Figure 5:
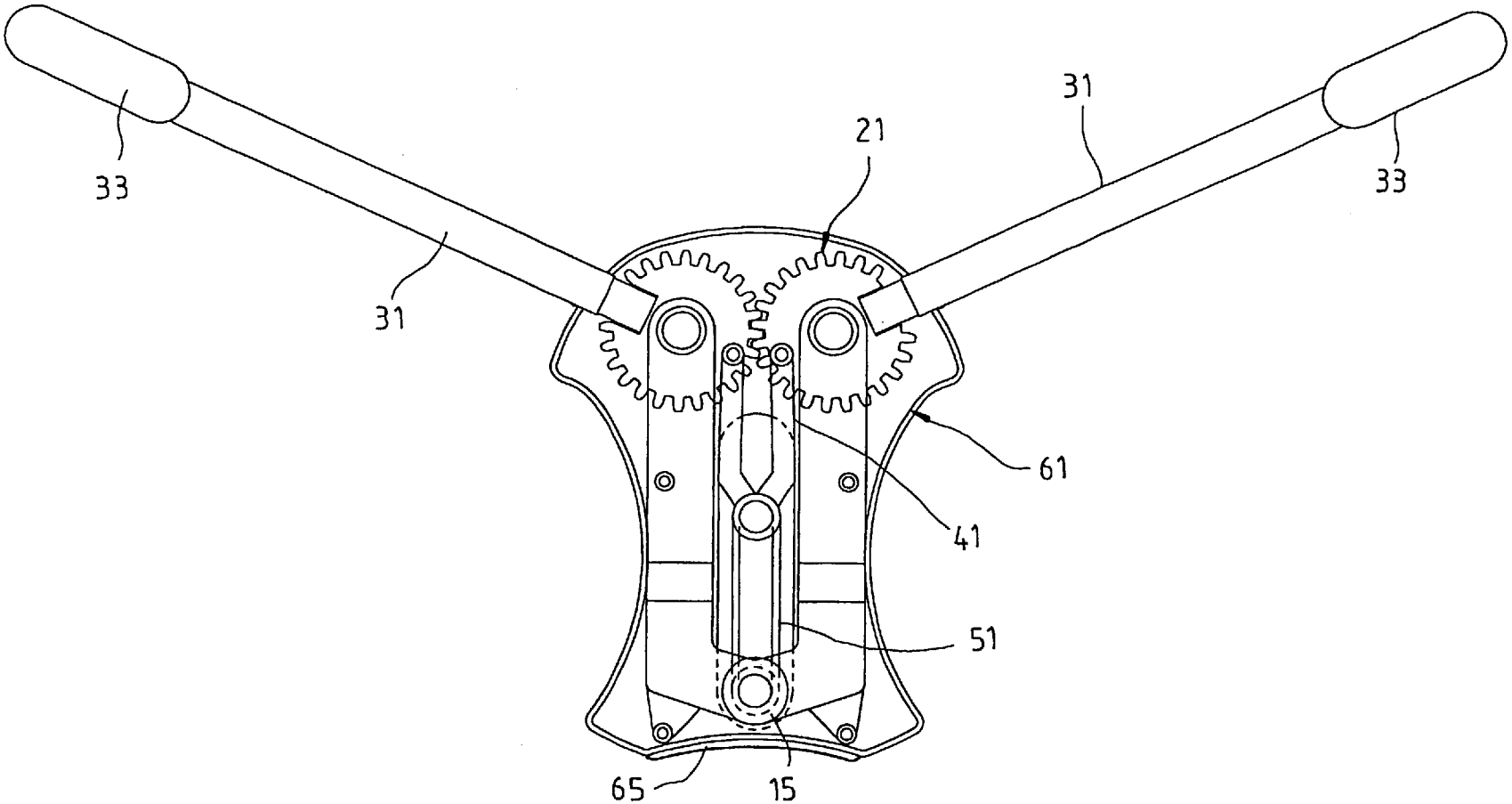
FIG. 5 shows a schematic view of the preferred embodiment of the present invention in action.
Figure 6:
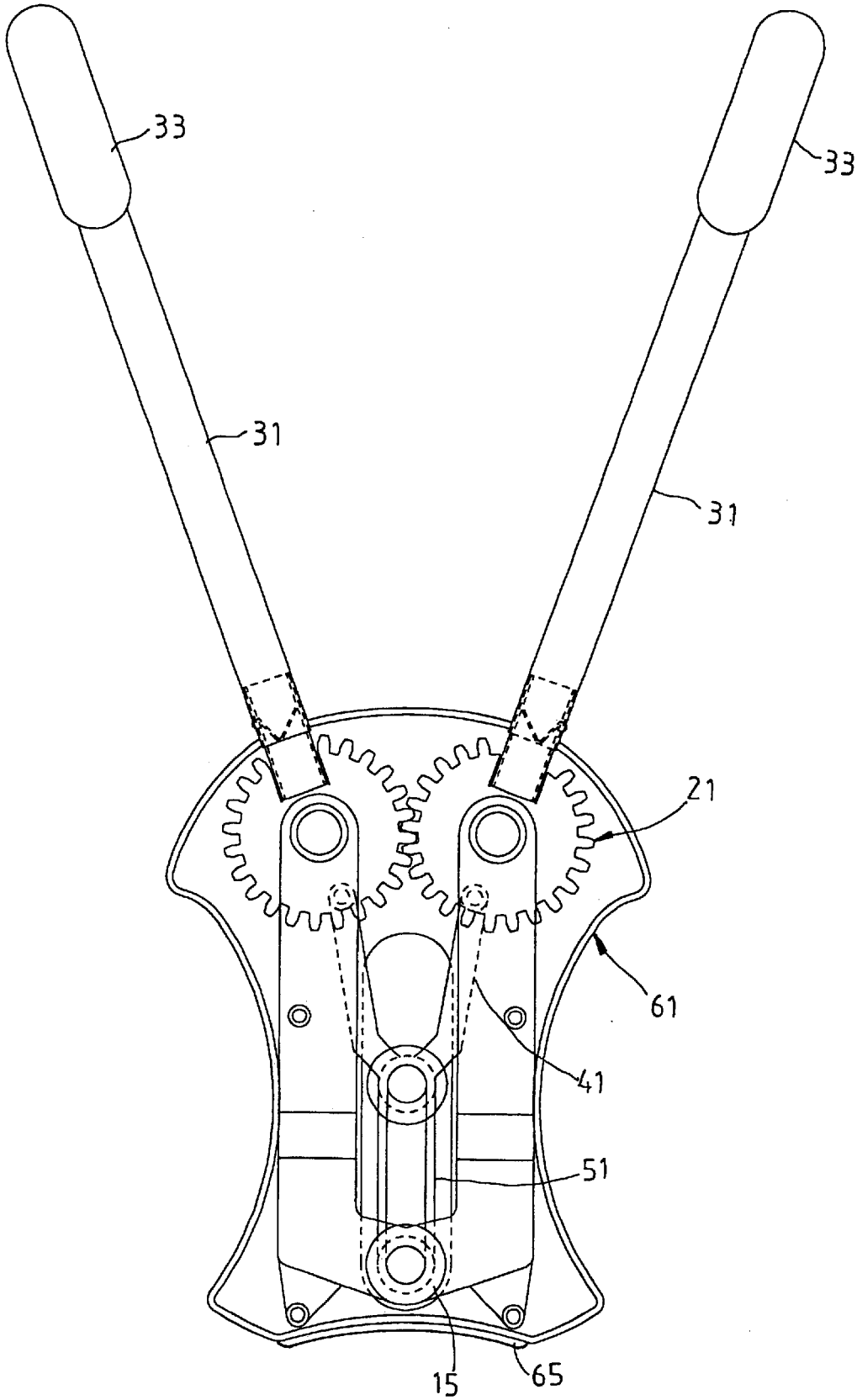
FIG. 6 shows another schematic view of the preferred embodiment of the present invention in action.

As shown in FIG. 4, the device is lifted with both hands holding the grips 33 such that the pad 65 is rested against the belly of the user of the device. The two grips 33 are pulled away from each other to cause the operation rods 31 to actuate the two engagement members 21 to rotate, thereby further actuating the traction members 41 to move toward the engagement members 21. As a result, the resilient member 51 is stretched, as shown in FIG. 5. A resistance force is thus brought about at the time when the two operation rods 31 are pulled apart. The two operation rods 31 are forced by the recovery force of the resilient member 51 to return to their initial positions, as shown in FIG. 6. The resilient member 51 of the present invention is an object having an elasticity, such as a spring or rubber ring.

What is claimed is:

1. An arm-building device comprising:

a frame having a coupling portion at a bottom thereof;

two engagement members rotatable mounted on the frame and meshed with each other, said engagement members provided with a connection portion and a pivoting portion spaced apart from an axis of said engagement member by a predetermined distance;

two operation rods rotatable engaged respectively at a first end with said connection portion of each of said engagement members and provided at a second end with a grip, wherein said operation rods can actuate said two engagement members to turn;

two traction members rotatably engaged respectively at a first end with said pivoting portion of each of said engagement members and a second end of each of said traction members rotatably engaged together by a bolt; and at least one resilient member, which is fastened at a first end with said coupling portion of said frame, and at a second end with said bolt;

wherein when said two engagement members are actuated to turn by said two operation rods said traction members are actuated to displace upward to stretch said resilient member and effect a resistance force against turning said operation rods.

2. The arm-building device as defined in claim 1, wherein each of said two engagement members is a toothed disk.

3. The arm-building device as defined in claim 2, wherein said connection portion is a tubular body extending outward from each of said toothed disk.

4. The arm-building device as defined in claim 2, wherein said pivoting portion is a hole located in each of said toothed disk.

5. The arm-building device as defined in claim 4, wherein said traction members have two connection arms extending parallel to each other and each end of said two connection arms being rotatably engaged to each of said toothed disk, said two connection arms and said coupling arms being rotatably engaged together by said bolt.

6. The arm-building device as defined in claim 1, wherein said resilient member is a rubber ring.

7. The arm-building device as defined in claim 1 further comprising a housing, having an operation hole at a top thereof from which enabling said operation rods extend outward.

8. The arm-building device as defined in claim 7, wherein said housing is provided with a long hole corresponding in location to said resilient member to facilitate the replacing of said resilient member.

9. The arm-building device as defined in claim 7, wherein said housing is provided in a bottom with a pad for engagement against the belly of a person operating the arm-building device.

* * * * *